US007515851B2

(12) United States Patent
Hirakawa et al.

(10) Patent No.: US 7,515,851 B2
(45) Date of Patent: Apr. 7, 2009

(54) ELECTRON EMITTER, CHARGER, AND CHARGING METHOD

(75) Inventors: Hiroyuki Hirakawa, Nara (JP); Tadashi Iwamatsu, Nara (JP); Nobuyoshi Koshida, Tokyo (JP)

(73) Assignees: Sharp Kabushiki Kaisha, Osaka (JP); Nobuyoshi Koshida, Tokyo (JP)

( * ) Notice: Subject to any disclaimer, the term of this patent is extended or adjusted under 35 U.S.C. 154(b) by 0 days.

(21) Appl. No.: 10/557,061

(22) PCT Filed: Apr. 28, 2004

(86) PCT No.: PCT/JP2004/006233

§ 371 (c)(1),
(2), (4) Date: Nov. 14, 2005

(87) PCT Pub. No.: WO2004/111736

PCT Pub. Date: Dec. 23, 2004

(65) Prior Publication Data

US 2006/0291905 A1 Dec. 28, 2006

(30) Foreign Application Priority Data

Jun. 13, 2003 (JP) ..... 2003-169466

(51) Int. Cl.
*G03G 15/02* (2006.01)

(52) U.S. Cl. ..... 399/168; 315/169.1

(58) Field of Classification Search ..... 399/168; 315/169.1

See application file for complete search history.

(56) References Cited

U.S. PATENT DOCUMENTS

2003/0090211 A1* 5/2003 Komoda et al. ..... 315/169.1

FOREIGN PATENT DOCUMENTS

CN 1419260 A 5/2003
JP 06-324556 11/1994

(Continued)

OTHER PUBLICATIONS

Yamaguchi, et al., *Development of High Efficiency Electron Source for Image Recording With Carbon Nanotube*; Japan Hardcopy 97 articles; The Imaging Society of Japan; Jul. 1997; pp. 221-224. (with English Language Translation).

(Continued)

*Primary Examiner*—David M Gray
*Assistant Examiner*—Bryan Ready
(74) *Attorney, Agent, or Firm*—Edwards Angell Palmer & Dodge LLP; David G. Conlin; David A. Tucker

(57) ABSTRACT

Provided are an electron emitter continuously emitting electrons stably even in the atmosphere, a charger using the electron emitter, and a charging method using the charger. The electron emitter includes a electron emitting element consisting of a first electrode, a second electrode, and a semiconductor layer formed therebetween, and a power supply for alternately applying a positive voltage enabling electron emission and a negative voltage having a polarity opposite to the positive voltage. At least a part of the surface on the first electrode side of the semiconductor layer is formed of a porous semiconductor layer. Electrons captured in the porous semiconductor layer in the course of electron emission with application of a positive voltage disturb electron emission from the electron emitting element. Such electrons, however, are removed by application of a negative voltage.

5 Claims, 7 Drawing Sheets

FOREIGN PATENT DOCUMENTS

| | | | |
|---|---|---|---|
| JP | 07-226146 | A | 8/1995 |
| JP | 09-114192 | | 5/1997 |
| JP | 2001-281964 | | 10/2001 |
| JP | 2001-296722 | | 10/2001 |
| JP | 2001-313151 | | 11/2001 |
| JP | 2001-331017 | | 11/2001 |
| JP | 2002-258585 | | 9/2002 |
| JP | 2002-311683 | | 11/2002 |
| JP | 2004-265603 | | 9/2004 |

OTHER PUBLICATIONS

Koshida, et al. *Luminescence and related Novel Functions of Quantum-sized Nanosilicon*,; The technical Report of the Institute of Elkectronics Information and Communication Engineers vol. 99, No. 136, Jun. 1999; pp. 1-6 (with partial English Language Translation).

* cited by examiner

ELECTRON EMITTER, CHARGER, AND CHARGING METHOD

TECHNICAL FIELD

The present invention relates to an electron emitter, a charger, and a charging method, and more particularly to an electron emitter, a charger, and a charging method for use in image forming devices such as electrophotographic copy machines, printers or facsimiles.

BACKGROUND ART

Conventionally, in an image forming device such as an electrophotographic copy machine, prior to forming an electrostatic latent image at a body to be charged such as a photoreceptor, the surface of the body to be charged is evenly charged by a variety of methods.

Conventional charging methods include, for example, corona discharge. In this method, the surface of a photoreceptor is charged by discharge from an extremely fine wire. This method, however, has a problem in that a high voltage power supply of about 4 to 10 kV is necessary to charge the surface of a photoreceptor. Moreover, the discharge from the wire causes a large amount of ozone in the space between the wire and the surface of the photoreceptor, which adversely effects human bodies and also accelerates degradation of the photoreceptor. In order to solve the problem, a corona charger that is improved to decrease the resulting amount of ozone is disclosed, for example, in Japanese Patent Laying-Open Nos. 09-114192 and 06-324556.

Another charging method employs a contact charging scheme, which has recently been put into practical use. In this method, in order to decrease the resulting amount of ozone and the power consumption, a conductive member such as a conductive roller, brush, elastic blade or carbon nanotube is brought into contact with a surface of a photoreceptor to charge the surface of the photoreceptor.

Currently, a roller charging scheme using a conductive roller as a conductive member is widely utilized in light of the stability of charging. In the roller charging scheme, a conductive roller is abutted under pressure on a photoreceptor by receiving a voltage to attain the charging of the photoreceptor. In the roller charging scheme, however, when the surface of the photoreceptor has any minute defect (pinhole), an abnormal amount of current leak occurs in the defect portion of the surface of the photoreceptor from the conductive roller, causing the surface of the photoreceptor to be destroyed, which may adversely affect image formation.

As a further improvement to the roller charging scheme, for example, Japanese Patent Laying-Open No. 2001-296722 discloses a scheme in which a secondary charging roller is added between a roller charging member (primary charging roller) and a photoreceptor. Here, the secondary charging roller serves to carry charges from the primary charging roller to the photoreceptor and aims to resolve the current leak problem caused by the pinhole in the photoreceptor. Also in this scheme, however, the charging phenomenon is dominated by minute discharge created in the narrow gap between the secondary charging roller and the photoreceptor. Therefore, it was impossible to completely remove ozone or $NO_x$ produced during charging.

Furthermore, for example, Japanese Patent Laying-Open No. 2001-281964 discloses that a carbon nanotube is applied to a contact-type charger. In the contact-type charger using a carbon nanotube, however, the pressing pressure of the carbon nanotube in contact with a photoreceptor causes physical destruction of the carbon nanotube and accordingly reduces the charging ability.

In addition, Japanese Patent Laying-Open No. 2001-331017 discloses a charger using an electron emitting element having an MIS (Metal-Insulator-Semiconductor) structure. In the electron emitting element, a thin film electrode for forming an acceleration electric field for electrons is provided on the front surface side of a porous semiconductor layer, and an electrode for injecting electrons to the porous semiconductor layer is provided on the back surface side of the porous semiconductor layer. The electron emission principle and fabrication method for the porous semiconductor layer formed of a porous silicon thin film is disclosed in detail in "Luminescence and Related Novel Functions of Quantum-sized Nanosilicon", the Technical Report of the Institute of Electronics Information and Communication Engineer of Japan, 1999-06, pp. 1-6. The charger using such an element only utilizes electron attachment caused by electrons emitted from the electron emitting element in order to generate negative ions and therefore does not produce ozone or $NO_x$ in principle as in the method using discharge as described above.

In the electron emitting element using the porous semiconductor layer, however, an electron, which attaches to a nanosized semiconductor particle (nano-silicon crystal) constituting the porous semiconductor layer due to charging (electron capture) caused during the operation of electron emission into the atmosphere, renders the electric field inside the porous semiconductor uneven, thereby preventing acceleration of electrons. The amount of electron emission is thus reduced. The electron stored in the nanosized semiconductor particle by this charging exhibits nonvolatility, and it is reported that some experimental result shows that the electron attached to a nanosized semiconductor particle over a week or longer. Generally, when this element is driven in the atmosphere, this charging causes electron emission from the electron emitting element to stop completely with continuous driving for about three minutes.

DISCLOSURE OF THE INVENTION

In view of the circumstances as described above, an object of the present invention is to provide an electron emitter capable of being stably driven for a long period of time, a charger using the same, and a charging method therefor.

The present invention provides an electron emitter including an electron emitting element having a semiconductor layer formed between a first electrode and a second electrode, in which at least a part of a surface of the semiconductor layer on a side of the first electrode is porous. A power supply is provided for alternately applying a positive voltage enabling electron emission and a negative voltage having an opposite polarity to the positive voltage to the first electrode.

Preferably, in the electron emitter of the present invention, an absolute value of a magnitude of the negative voltage is at least 1.5 times as large as an absolute value of a magnitude of an electron emission starting voltage of the electron emitter.

Preferably, in the electron emitter of the present invention, a ratio $t1/t2$ between an application time $t1$ of the positive voltage and an application time $t2$ of the negative voltage is at least 1 and at most 1000.

Preferably, in the electron emitter of the present invention, a plurality of first electrodes are formed, and a power supply may be provided for alternately applying respective voltages different in polarity to at least one of the first electrodes and at least one of the rest.

The present invention also provides a charger including the aforementioned electron emitter and a body to be charged arranged opposing to and spaced apart from the first electrode of the electron emitter.

The present invention also provides a charging method in an electron emitter including an electron emitting element having a semiconductor layer formed between a first electrode and a second electrode, in which at least a part of a surface of the semiconductor layer on a side of the first electrode is porous. A positive voltage enabling electron emission and a negative voltage having an opposite polarity to the positive voltage are alternately applied to the first electrode of the electron emitter.

BEST MODE FOR CARRYING OUT THE INVENTION

Figure 1:
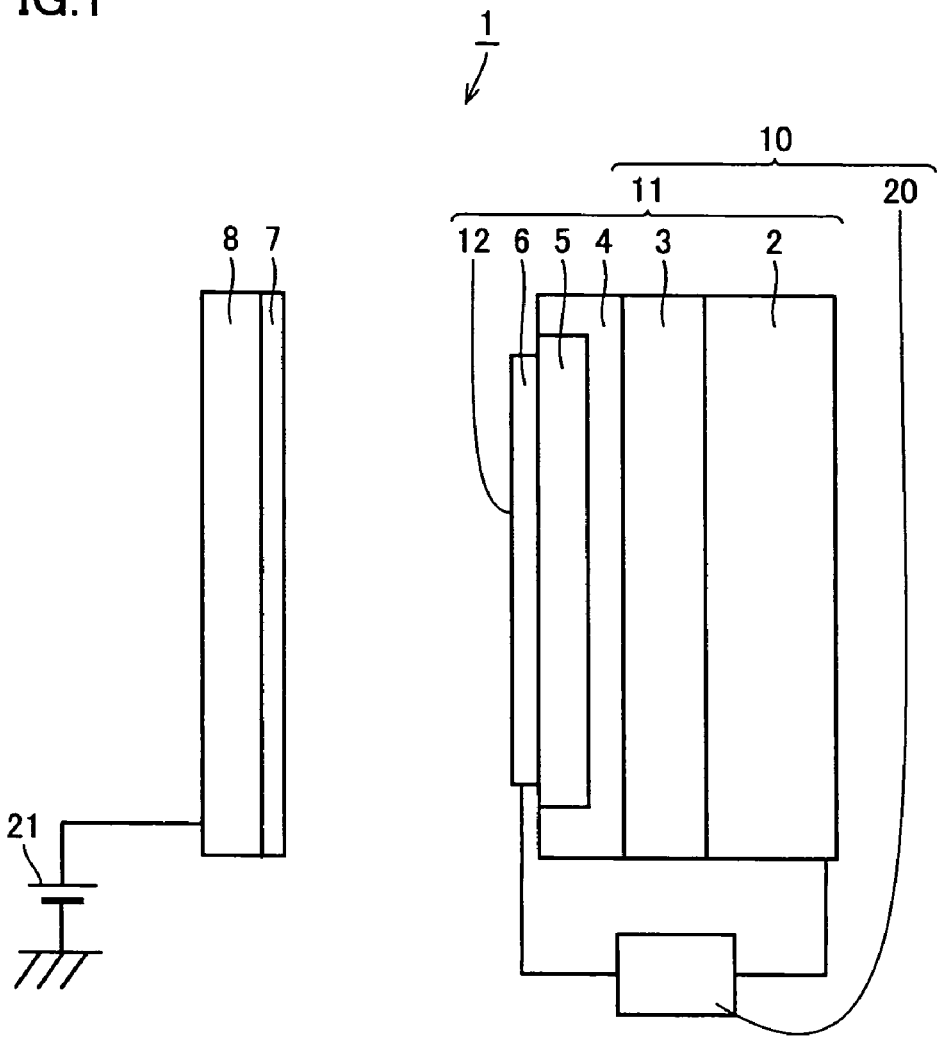
FIG. 1 is a schematic structural view of a preferred exemplary charger in accordance with the present invention.

In the following, the embodiments of the present invention will be described. It is noted that in the figure of the specification, the same reference characters refer to the same parts or corresponding parts.

FIG. 1 shows a schematic conceptual view of a preferred exemplary charger in accordance with the present invention. This charger 1 includes an electron emitter 10 and a photoreceptor 7 as a body to be charged that is arranged opposing to and spaced apart from an electron emitting surface 12 that is a surface of an acceleration electrode 6 of electron emitter 10.

Electron emitter 10 includes an electron emitting element 11 constituted with a base electrode 2 formed of a conductive substrate, an n-type silicon layer 3 formed on base electrode 2, a non-doped thin polysilicon layer 4 formed on n-type silicon layer 3, a porous polysilicon layer 5 formed by rendering a part of polysilicon layer 4 porous, and an acceleration electrode 6 formed of a gold thin film formed on porous polysilicon layer 5. Electron emitter 10 further includes a driving power supply 20 electrically connected to each of base electrode 2 and acceleration electrode 6 to enable supply of a voltage having a pulse waveform, a sinusoidal waveform, a triangular waveform or the like.

On the other hand, photoreceptor 7 is formed on a surface of a drum-shaped conductive supporting substrate 8 made of aluminum or the like with a thickness of approximately 25 μm. A bias power supply 21 serving as a direct current voltage source is connected to conductive supporting substrate 8.

Here, in the charger 1 as shown in FIG. 1, driving power supply 20 of electron emitter 10 applies a positive voltage to acceleration electrode 6, and bias power supply 21 applies a positive voltage to conductive supporting substrate 8. Then, the electron supplied from driving power supply 20 to base electrode 2 is accelerated to the acceleration electrode 6 side by the electric field inside electron emitting element 11, which is produced by application of a positive voltage to acceleration electrode 6. Then, the accelerated electron is attracted to conductive supporting substrate 8 receiving a positive voltage, so that the electron is emitted from electron emitting surface 12, which is the surface of acceleration electrode 6, and attaches to the surface of photoreceptor 7.

Here, in the present invention, driving power supply 20 alternately applies to acceleration electrode 6 a positive voltage enabling electron emission and a negative voltage having a polarity opposite to the positive voltage. Therefore, even if an electron is captured in a nano-silicon crystal constituting porous polysilicon layer 5 in the course of electron emission, a negative voltage having a polarity opposite to a positive voltage is thereafter applied to acceleration electrode 6, so that the captured electron can be removed from the nano-silicon crystal. Accordingly, when a positive voltage is applied to acceleration electrode 6 again, the electron accelerated to the acceleration electrode 6 side inside electron emitting element 11 is stably emitted outside electron emitting element 11 without being affected by the electron captured in the nano-silicon crystal in porous polysilicon layer 5.

In this way, because of the alternate application of a positive voltage and a negative voltage to acceleration electrode 6, while the electrons captured in the nano-silicon crystal constituting porous polysilicon layer 5 are removed, electrons can be emitted outside electron emitting element 11. Therefore, charger 1 and electron emitter 10 in accordance with the present invention can be driven stably for a long period of time.

Here, the absolute value of the magnitude of the negative voltage is preferably 1.5 or more times as large as the absolute value of the magnitude of the electron emission starting voltage of electron emitter 10. In this case, a sufficient amount of current flows in the direction from base electrode 2 to acceleration electrode 6 inside electron emitting element 11, so that the electron captured within porous polysilicon layer 5 may tend to be removed from porous polysilicon layer 5 effectively. It is noted that "electron emission starting voltage" refers to a voltage that is applied to acceleration electrode 6 when electron emission from electron emitter 10 is started.

A ratio t1/t2 between an application time t1 of a positive voltage and an application time t2 of a negative voltage is preferably 1 or more and 1000 or less. When t1/t2 is 1 or more, electron emission from electron emitter 11 may tend to be performed sufficiently. In particular, when t1 is sufficiently longer than t2, electron emission may tend to be performed continuously since the period of time during which electron emission halts can be regarded as approximately zero. On the other hand, when t1/t2 is 1000 or less, an electron is not captured in porous polysilicon layer 5 and stable electron emission tends to be enabled. Furthermore, with t1 set within 3 seconds, even more stable electron emission is enabled.

The forgoing was found by the present inventor according to the experimental result as described below.

Figure 2:
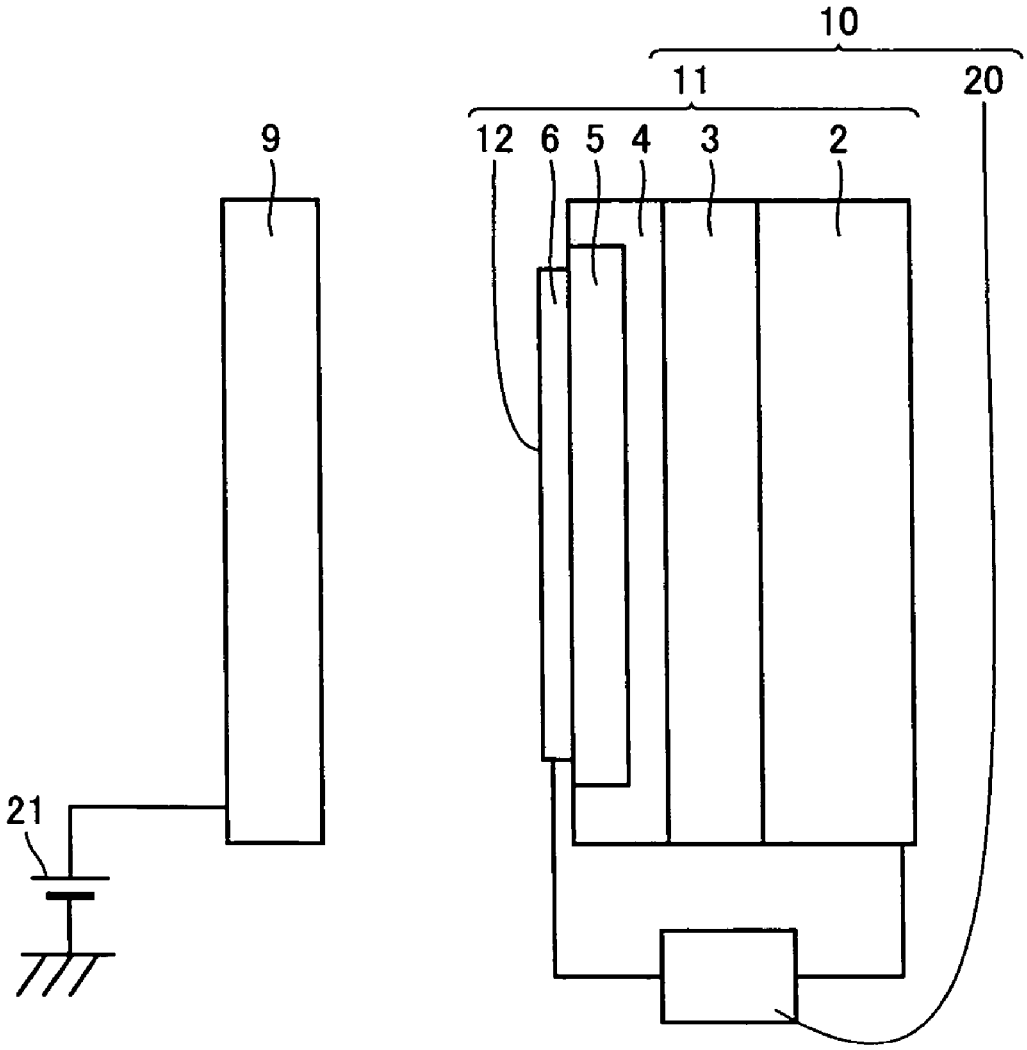
FIG. 2 is a schematic structural view of an electron emitter and a counter electrode for use in an experiment in accordance with the present invention.
Figure 3:
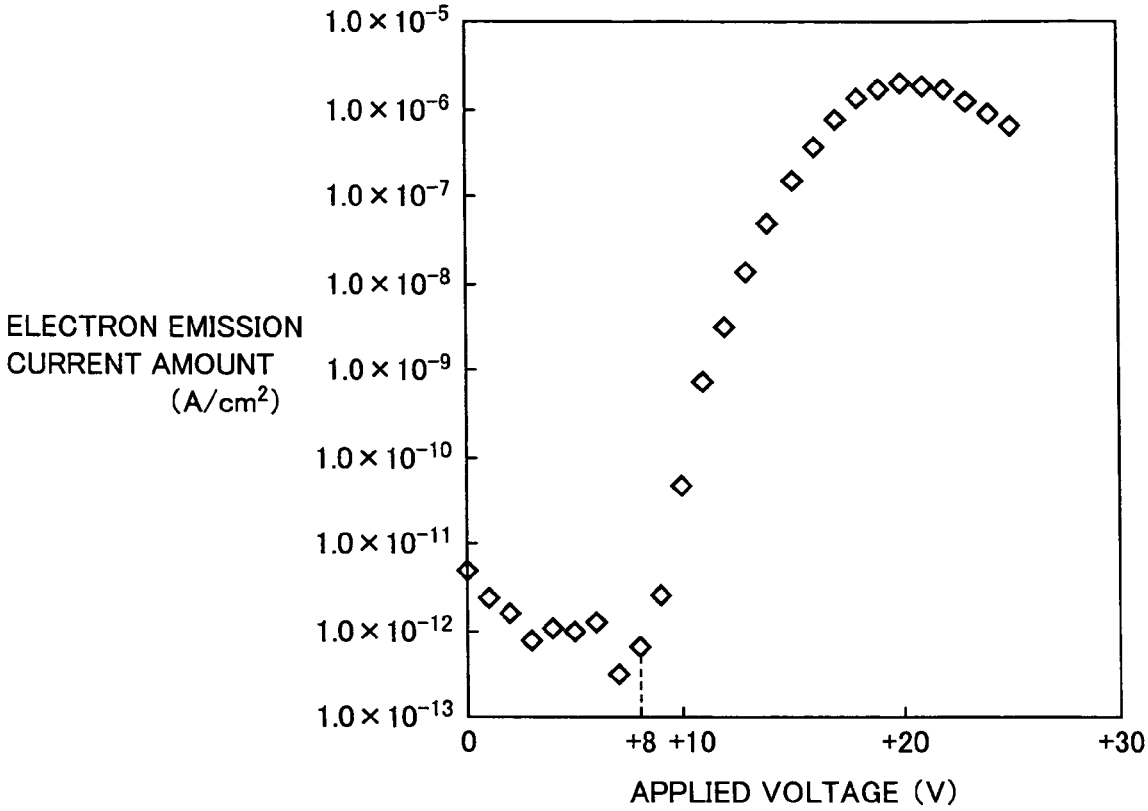
FIG. 3 is a diagram showing the relationship between an applied voltage and an electron emission current amount in the atmospheric pressure in the electron emitter in accordance with the present invention.

First, FIG. 3 shows the relationship between a voltage (V) applied to acceleration electrode 6 and an amount of electron emission current ($A/cm^2$) produced by the electron emitted from electron emitter 10 shown in FIG. 2 to flow into a counter electrode 9, in the atmospheric pressure (room atmosphere). In FIG. 3, the axis of abscissas shows a value of a voltage applied to acceleration electrode 6 for 1 second and the axis of ordinates shows the mean value of the amount of the electron emission current flowing per 1 $cm^2$ of counter electrode 9 for 1 second by the application of the voltage. Here, the distance between electron emitting surface 12 of acceleration electrode 6 and the surface of counter electrode 9 as shown in FIG. 2 is 1 mm and the bias voltage applied to counter electrode 9 by bias power supply 21 is +100V.

In electron emitter 10 shown in FIG. 2, the electron emission current starts to be measured when the applied voltage shown in FIG. 3 becomes +8V. Thereafter, the amount of electron emission current increases as the applied voltage rises from +8V.

Figure 4:
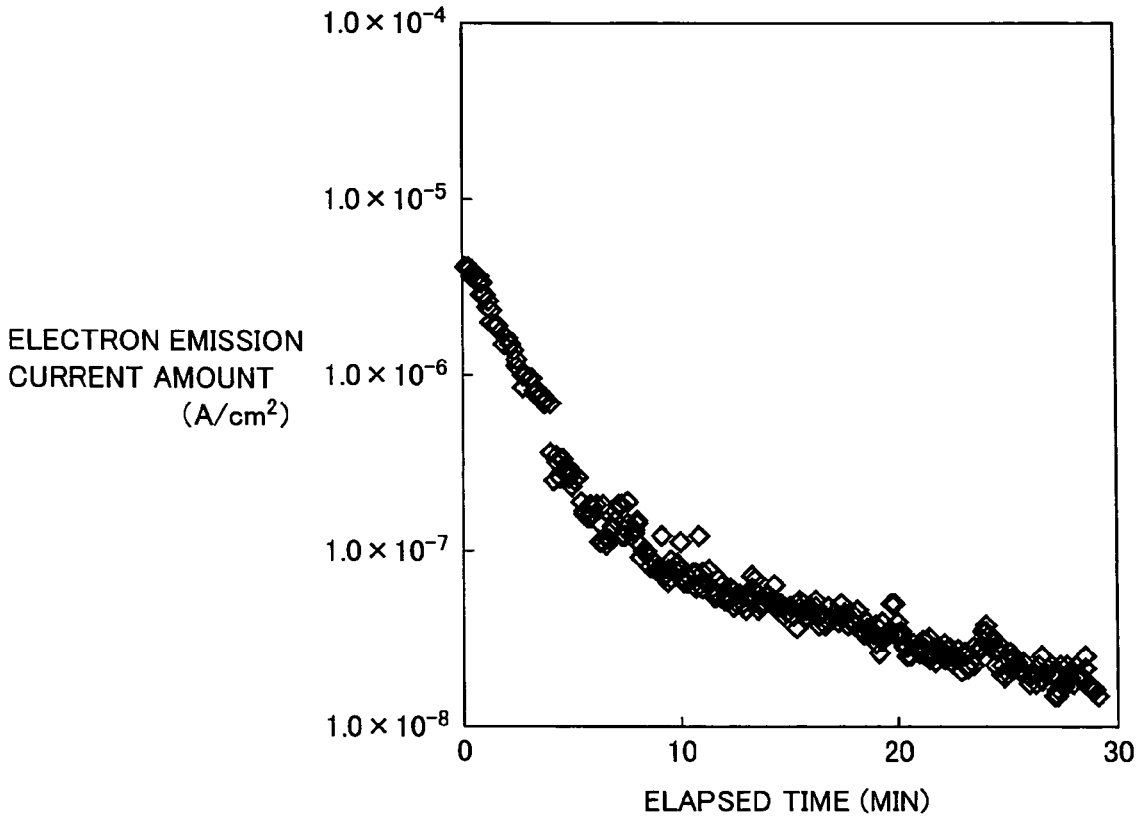
FIG. 4 is a diagram showing a transition of an electron emission current amount with respect to the elapsed time when a positive voltage is continuously applied to an acceleration electrode.

In the atmospheric pressure, however, when a positive voltage is continuously applied to acceleration electrode 6 of the electron emitter 10, as shown in FIG. 4, the amount of electron emission current ($A/cm^2$) decreases exponentially. This is because electrons are gradually captured in the nano-silicon crystal constituting porous polysilicon layer 5. It is noted that in FIG. 4 the axis of abscissas shows the elapsed time (minute) immediately after +18V is applied to acceleration electrode 6.

Figure 5:
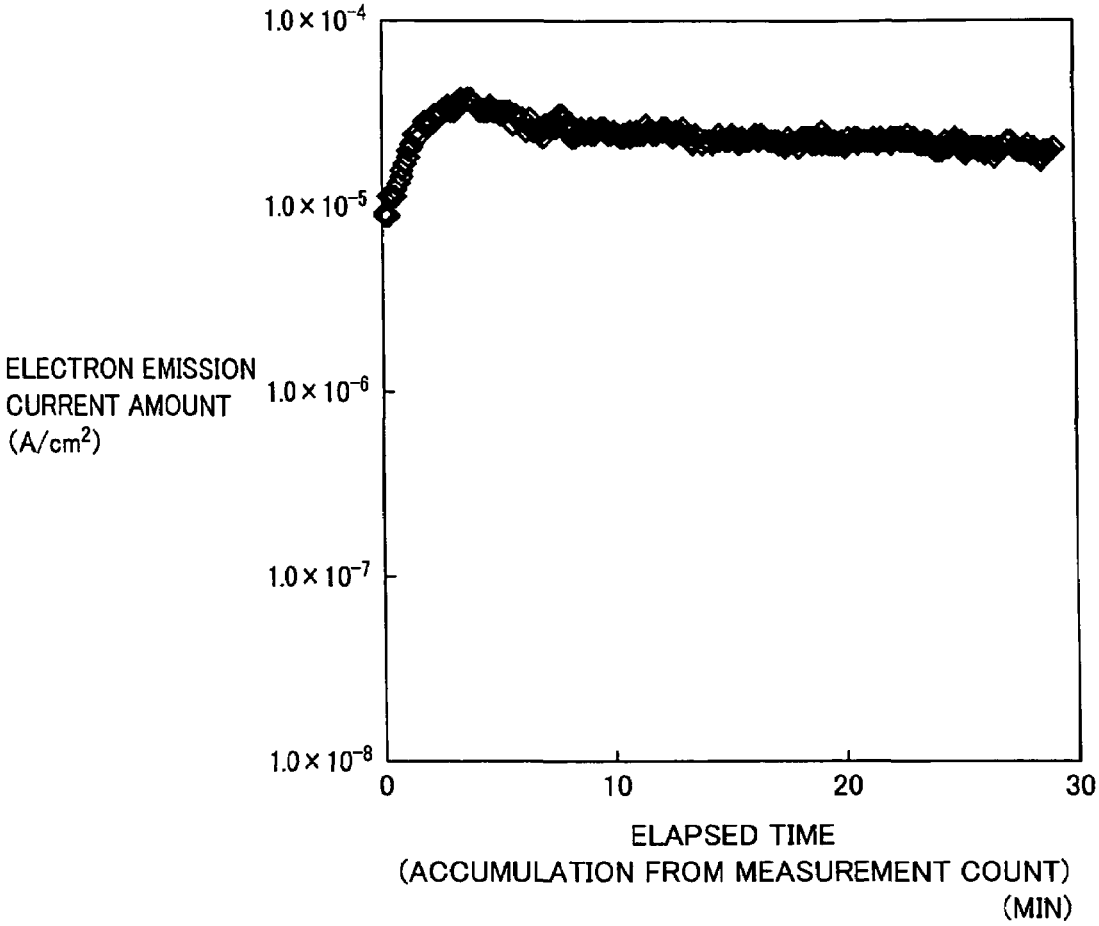
FIG. 5 is a diagram showing a transition of an electron emission current amount with respect to the elapsed time when a positive voltage and a negative voltage are alternately applied to the acceleration electrode.
Figure 6:
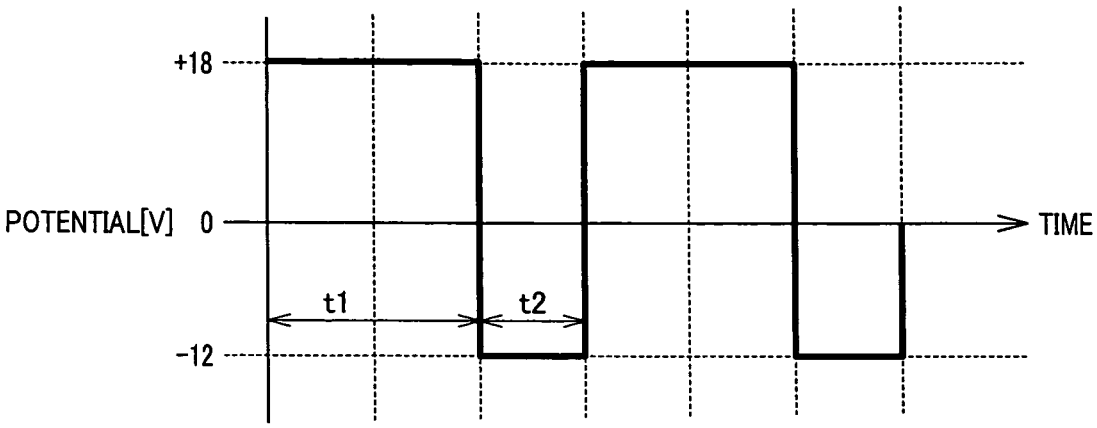
FIG. 6 is a diagram showing an exemplary waveform of a voltage applied to the acceleration electrode of the electron emitter in accordance with the present invention.

Now, FIG. 5 shows the result of the measurement of the amount of electron emission current in counter electrode 9 when a positive voltage and a negative voltage are alternately applied to acceleration electrode 6 of electron emitter 10. Here, the waveform of the voltage applied to acceleration electrode 6 is in the form of pulses as shown in FIG. 6. In FIG. 6, the application time of a positive voltage enabling electron emission is t1, and the application time of a negative voltage is t2. In addition, the ratio between t1 and t2 (t1/t2) is 2.

As shown in FIG. 5, when a negative voltage is applied to acceleration electrode 6 at certain intervals, the amount of electron emission current ($A/cm^2$) is kept stable as compared with the case shown in FIG. 4.

It is noted that the value of the positive voltage applied to acceleration electrode 6 is preferably decided according to the amount of electron emission current as required. Here, it is set at +18V. The value of the negative voltage is decided according to the following experimental result.

Figure 7:
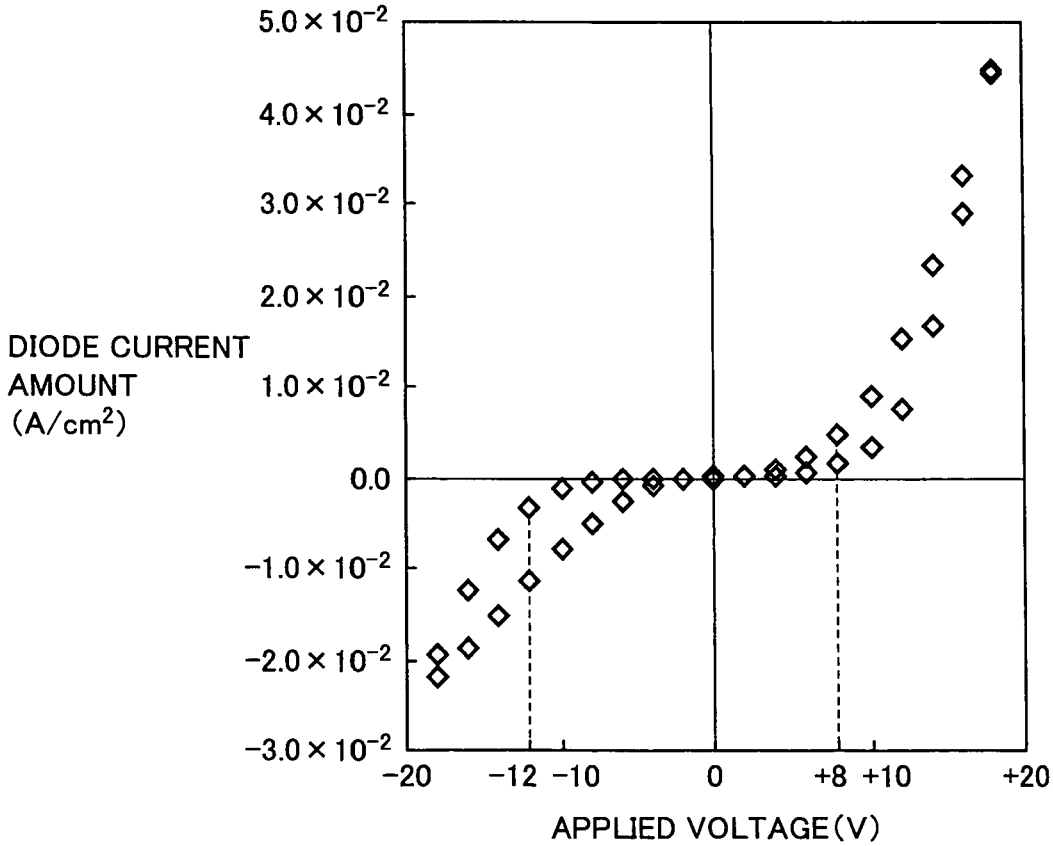
FIG. 7 is a diagram showing a transition of a diode current amount with respect to an applied voltage to be applied to the acceleration electrode of the electron emitter in accordance with the present invention.

FIG. 7 shows the result of the measurement of the amount of diode current flowing in electron emitting element 11 when voltages are applied to acceleration electrode 6 of electron emitter 10 shown in FIG. 2 for 1 second at intervals of 2 V in the order of 0V→−18V→0V→+18V→0V. In FIG. 7, the axis of abscissas shows a voltage (V) applied to acceleration electrode 6 and the axis of ordinates shows the amount of diode current ($A/cm^2$) flowing per 1 $cm^2$ of electron emitting element 11. It is noted that in FIG. 7 a positive value of the amount of diode current shows that the diode current flows in the direction from acceleration electrode 6 to base electrode 2 (forward direction), and a negative value of the amount of diode current shows that the diode current flows in the direction from base electrode 2 to acceleration electrode 6 (reverse direction).

As described above, the electron emission starting voltage of electron emitting element 11 is +8V. In the course of 0V→−18V, the diode current in the reverse direction starts to flow after the applied voltage is set to −10V, and the current amount is −300 $\mu A/cm^2$ when the applied voltage is set to −12 V.

As shown in FIG. 4, when a positive voltage is continuously applied to acceleration electrode 6, electrons are captured in porous polysilicon layer 5 and the amount of electron emission current gradually decreases. The captured electron is held for an extremely long period of time when the diode current is continuously fed in the forward direction or when acceleration electrode 6 is left in an open state (it is reported that the electron was held for one week or longer according to "Light Emission and Novel Function of Quantum Size Nano-Silicon," the Technical Report of the Institute of Electronics Information and Communication Engineer of Japan, 1999-06, pp. 1-6). However, the captured electron can be removed from porous polysilicon layer 5 by applying a negative voltage to acceleration electrode 6 to cause an appropriate amount of diode current to flow in the reverse direction. Here, when a negative voltage of −12 V or higher is applied to acceleration electrode 6, the captured electrons are completely removed from porous polysilicon layer 5. Accordingly, the amount of electron emission current can be restored to the approximately initial value.

Therefore, in order to restore the electrons captured in porous polysilicon layer 5 to the initial state, the absolute value of the magnitude of the negative voltage (12V) applied to acceleration electrode 6 should be 1.5 or more times as large as the absolute value of the magnitude of the electron emission starting voltage (8V) of electron emitter 10.

The similar characteristics as described above are also obtained when the ratio t1/t2 between the positive voltage application time t1 and the negative voltage application time t2 is varied. In other words, when t1/t2 is 1 or more and 1000 or less, the captured electrons can be restored to the initial state stably. However, if t1 is too long, depending on the design of porous polysilicon layer 5, the influence of electron capture appears in the amount of electron emission current. Thus, t1 is preferably set within 3 seconds at longest.

A preferred exemplary method of manufacturing electron emitter 10 having such a structure in accordance with the present invention will be described below. First, n-type silicon layer 3 is formed on base electrode 2. Then, non-doped polysilicon layer 4 having a film thickness of about 1.5 μm is formed on the surface of n-type silicon layer 3, for example, by CVD (Chemical Vapor Deposition) method. Thereafter, polysilicon layer 4 as an anode and a platinum electrode as a cathode are soaked in a mixture solution of hydrogen fluoride aqueous solution and ethanol. With polysilicon layer 4 being irradiated with light, a constant current (30 $mA/cm^2$) is fed between these electrodes for an anodic oxidation treatment. This anodic oxidation treatment renders a part of polysilicon layer 4 porous, resulting in porous polysilicon layer 5. Thereafter, this stacked structure is removed from the solution, and the surface of porous polysilicon layer 5 is subjected to thermal oxidation for 1 hour at about 900° C. with oxygen gas flow fed at a rate of 300 ml/min. Then, a thin film formed of gold is formed at a thickness of about 10 nm on the surface of porous polysilicon layer 5 by a deposition method or a sputtering method to form acceleration electrode 6. Electron emitting element 11 is thereby formed. Finally, driving power supply 20 is electrically connected to each of base electrode 2 and acceleration electrode 6, whereby electron emitter 10 in accordance with the present invention is formed.

It is noted that although gold is used as a material of acceleration electrode 6 in the foregoing description, aluminum or the like may be used.

Figure 8:
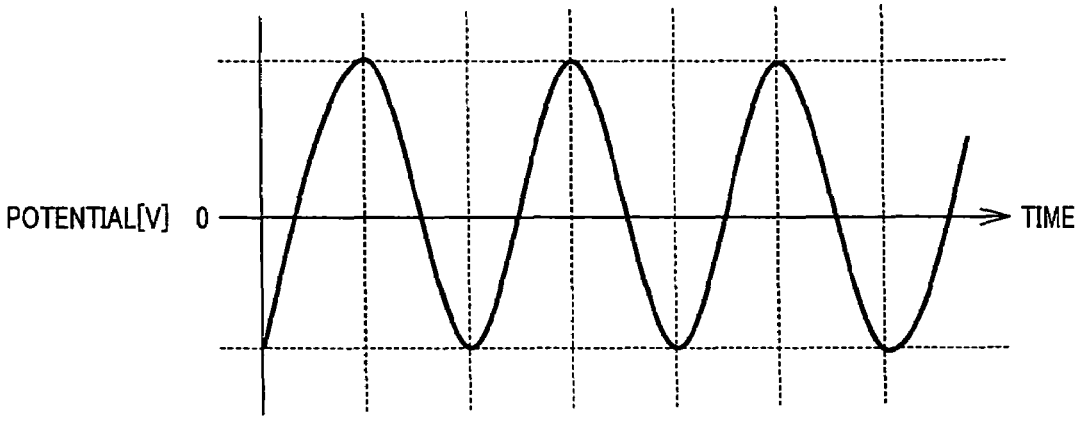
FIG. 8 is a diagram showing another exemplary waveform of a voltage applied to the acceleration electrode of the electron emitter in accordance with the present invention.

Alternatively, in the present invention, the waveform of the voltage applied to acceleration electrode 6 may be a sinusoidal waveform as shown in FIG. 8. In this case, the reference potential of the sinusoidal wave may not necessarily be 0 V. Furthermore, a direct current component may be superposed as long as such a condition is satisfied that the absolute value of the magnitude of the negative voltage is 1.5 or more times as large as the absolute value of the magnitude of the electron emission starting voltage of electron emitting element 11. Specifically, the application of a voltage having a sinusoidal waveform of 1 Hz at a peak value of 18V enables even more stable electron emission.

Figure 9:
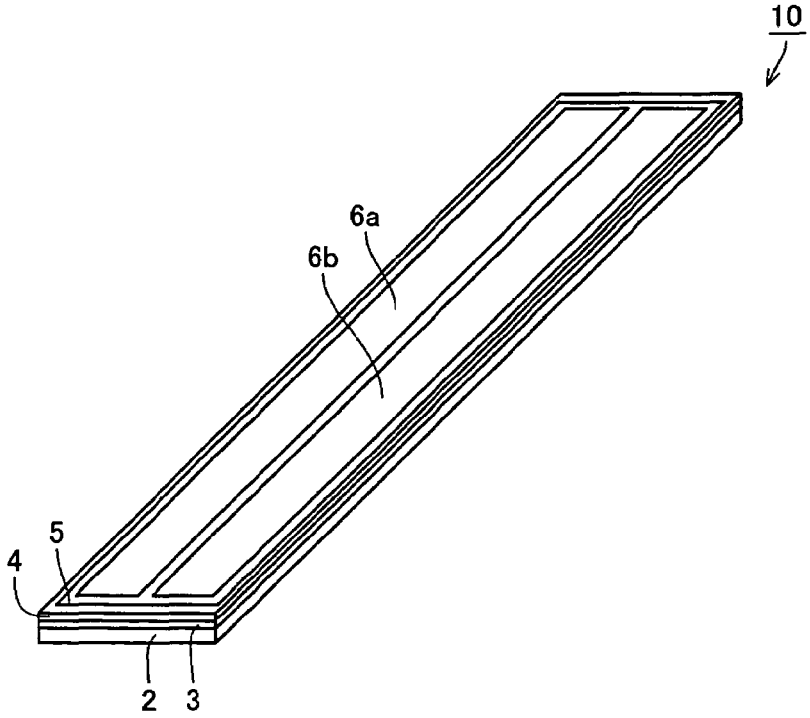
FIG. 9 is a schematic perspective view of a part of an electron emitter in accordance with another embodiment of the present invention.

FIG. 9 shows a schematic perspective view of a partial electron emitter in accordance with another embodiment of the present invention.

This electron emitter 10 is characterized by two acceleration electrodes, that is, an acceleration electrode 6*a* and an acceleration electrode 6*b*, which are not electrically connected to each other. Acceleration electrodes 6*a*, 6*b* are arranged respectively parallel to the longitudinal direction of electron emitter 10. Here, using a not-shown power supply, when a positive voltage is applied to acceleration electrode 6*a*, a negative voltage is applied to acceleration electrode 6*b*, and when a positive voltage is applied to acceleration electrode 6*b*, a negative voltage is applied to acceleration electrode 6*a*. In other words, respective voltages having different polarities are alternately applied to acceleration electrode 6*a* and acceleration electrode 6*b*.

In this manner, when a positive voltage is applied to acceleration electrode 6*a*, the electrons captured in porous polysilicon layer 5 below acceleration electrode 6*b* can be removed while electrons being emitted from acceleration electrode 6*a*. On other hand, when a negative voltage is applied to acceleration electrode 6*a*, electrons can be emitted from acceleration electrode 6*b* while electrons captured in porous polysilicon layer 5 below acceleration electrode 6*a* being removed. Since electrons can continuously be emitted by repeatedly performing these operations alternately, the surface of a body to be charged can bear electrons uniformly.

It is noted that, not being limited to two as described above, a plurality of acceleration electrodes may be arranged such as three or four. When the number of acceleration electrodes is increased, the charging distribution is effectively made uniform on the surface of the body to be charged, and in addition electron emitter 10 can be driven with a margin. Therefore, the life of electron emitter 10 is advantageously prolonged.

The charger 1 and electron emitter 10 in accordance with the present invention as described above is suitably used especially in image forming devices such as electrophotographic copy machines, printers, facsimiles since it can be driven stably for a long period of time.

In accordance with the present invention as described above, there can be provided an electron emitter that can be stably driven for a long period of time, a charger using the same, and a charging method therefor.

It should be understood that the embodiments disclosed herein should be taken by way of illustration rather than by way of limitation in all aspects. The scope of the present invention is shown not in the foregoing description but in the claims, and it is intended that equivalents to the claims and all modifications within the claims are embraced herein.

INDUSTRIAL APPLICABILITY

The present invention is suitably used especially in image forming devices such as electrophotographic copy machines, printers, or facsimiles.

The invention claimed is:

1. An electron emitter for emitting electrons into a surrounding atmosphere toward a counter electrode disposed in opposing, spaced apart relation thereto, said electron emitter comprising an electron emitting element having a semiconductor layer formed between a first electrode and a second electrode, at least part of a surface of said semiconductor layer on a side of said first electrode being porous, characterized in that a power supply is provided for alternately applying a positive voltage and a negative voltage having an opposite polarity to said positive voltage to said first electrode, said positive voltage being at least sufficient to enable electron emission, wherein said electron emitter is further characterized in that an absolute value of a minimum magnitude of said negative voltage, which gives rise to a minimum negative current flow in said electron emitter, is at least 1.5 times as large as an absolute value of a minimum magnitude of said positive voltage, which gives rise to a minimum positive current flow in said electron emitter.

2. The electron emitter according to claim 1, characterized in that a ratio t1/t2 between an application time t1 of said positive voltage and an application time t2 of said negative voltage is at least 1 and at most 1000.

3. The electron emitter according to claim 1, characterized in that a plurality of said first electrodes are formed, and in that a power supply is provided for alternately applying voltages different in polarity to at least one of said first electrodes and at least one of the rest.

4. A charger comprising an electron emitter according to claim 1 wherein said counter electrode comprises a body to be charged that is arranged opposite to and spaced apart from a surface of said first electrode of said electron emitter.

5. A charging method for charging a body to be charged comprising:

providing an electron emitter for emitting electrons into a surrounding atmosphere toward said body to be charged disposed in opposing, spaced apart relation thereto, said electron emitter including an electron emitting element having a semiconductor layer formed between a first electrode and a second electrode, at least part of a surface of said semiconductor layer on a side of said first electrode being porous, and alternately applying a positive voltage and a negative voltage having an opposite polarity to said positive voltage to said first electrode, said positive voltage being at least sufficient to enable electron emission from said electron emitter, wherein said electron emitter is further characterized in that an absolute value of a minimum magnitude of said negative voltage, which gives rise to a minimum negative current flow in said emitter, is at least 1.5 times as large as an absolute value of a minimum magnitude of said positive voltage, which gives rise to a minimum positive current flow in said emitter.

* * * * *